US007531728B2

(12) United States Patent
Nguyen

(10) Patent No.: US 7,531,728 B2
(45) Date of Patent: May 12, 2009

(54) ELECTRIC GUITAR

(75) Inventor: The Hai Nguyen, Aldingen-Aixheim (DE)

(73) Assignee: Matth, Hohner AG, Trossingen (DE)

( * ) Notice: Subject to any disclaimer, the term of this patent is extended or adjusted under 35 U.S.C. 154(b) by 0 days.

(21) Appl. No.: 12/042,219

(22) Filed: Mar. 4, 2008

(65) Prior Publication Data

US 2008/0229896 A1 Sep. 25, 2008

(30) Foreign Application Priority Data

Mar. 23, 2007 (DE) ..... 10 2007 013 933

(51) Int. Cl.
*G10D 3/00* (2006.01)

(52) U.S. Cl. ..... 84/291; 84/327; 84/328; 84/329

(58) Field of Classification Search ..... 84/267, 84/291, 327, 328, 329
See application file for complete search history.

(56) References Cited

U.S. PATENT DOCUMENTS

| | | | | | |
|---|---|---|---|---|---|
| 774,750 | A * | 11/1904 | Gladieux | ..... | 84/273 |
| 1,261,841 | A * | 4/1918 | Mortensen | ..... | 84/327 |
| 1,285,802 | A * | 11/1918 | Russell | ..... | 84/327 |
| 1,802,236 | A * | 4/1931 | Carroll et al. | ..... | 84/327 |
| 1,945,162 | A * | 1/1934 | Rasmussen | ..... | 84/327 |
| 2,884,828 | A * | 5/1959 | Montenare | ..... | 84/327 |
| 4,192,213 | A * | 3/1980 | Steinberger | ..... | 84/293 |
| RE31,722 | E * | 11/1984 | Steinberger | ..... | 84/327 |
| 4,592,265 | A * | 6/1986 | Steinberger | ..... | 84/327 |
| 4,632,002 | A * | 12/1986 | Clevinger | ..... | 84/731 |
| 4,656,917 | A * | 4/1987 | Van Halen | ..... | 84/327 |
| 4,890,530 | A * | 1/1990 | Tatsumi | ..... | 84/291 |
| 6,573,439 | B2 * | 6/2003 | Wilson | ..... | 84/291 |
| 6,703,546 | B1 | 3/2004 | Wilson | | |
| 2008/0229896 | A1 * | 9/2008 | Nguyen | ..... | 84/291 |

FOREIGN PATENT DOCUMENTS

| | | |
|---|---|---|
| DE | 3132017 | 5/1982 |
| JP | 11305762 | 5/1999 |
| WO | WO8804462 | 6/1988 |

* cited by examiner

*Primary Examiner*—Jeffrey Donels
*Assistant Examiner*—Robert W Horn
(74) *Attorney, Agent, or Firm*—Townsend and Townsend and Crew LLP

(57) ABSTRACT

Electric guitar with a neck and a body which has a first side wall, facing the guitar player, and a second side wall, facing away from the guitar player, said side walls delimiting a front and a back of the body at the edges, wherein the second side wall has an associated arcuate bow extending along it at least in sections which can have its distance from the second side wall adjusted and whose arc shape can be rotated into a concave and a convex position relative to the side wall.

6 Claims, 2 Drawing Sheets

ELECTRIC GUITAR

BACKGROUND OF THE INVENTION

The invention relates to an electric guitar, and in particular to a guitar with a neck and a body.

Examples of some electric guitars are described in DE-U-20 2006 010 748 and DE-U-20 2005 005 270.Accordingly, the body of the electric guitars is usually smaller than that of a classical acoustic guitar and preferably comprises a solid or essentially filled body. To incorporate the tonal characteristics of acoustic instruments into the electric guitar sound in advantageous fashion, the body of electric guitars may also be provided with cavities. A drawback of all these electric guitars, however, is that their physical shape makes them difficult to use as an acoustic guitar.

BRIEF SUMMARY OF THE INVENTION

It is therefore an object of the present invention to provide an electric guitar which is easy and comfortable to play acoustically. Such a guitar may have a neck and a body which has a first side wall, facing the guitar player, and a second side wall, facing away from the guitar player, said side walls delimiting a front and a back of the body at the edges, wherein the second side wall has an associated arcuate bow extending along it at least in sections which can have its distance from the second side wall adjusted and whose arc shape can be rotated into a concave and a convex position relative to the side wall The result of this is an electric guitar which allows the body to be given a variable ergonomic external contour by means of a boom in the form of a bow. Such an electric guitar can easily and comfortably be played both while sitting, when the electric guitar is preferably played acoustically, and while standing. The musician can adopt a sound body posture while playing and vary the playing angle.

Further refinements of the invention can be found in the description below and in the subclaims.

DETAILED DESCRIPTION OF THE INVENTION

Figure 1:
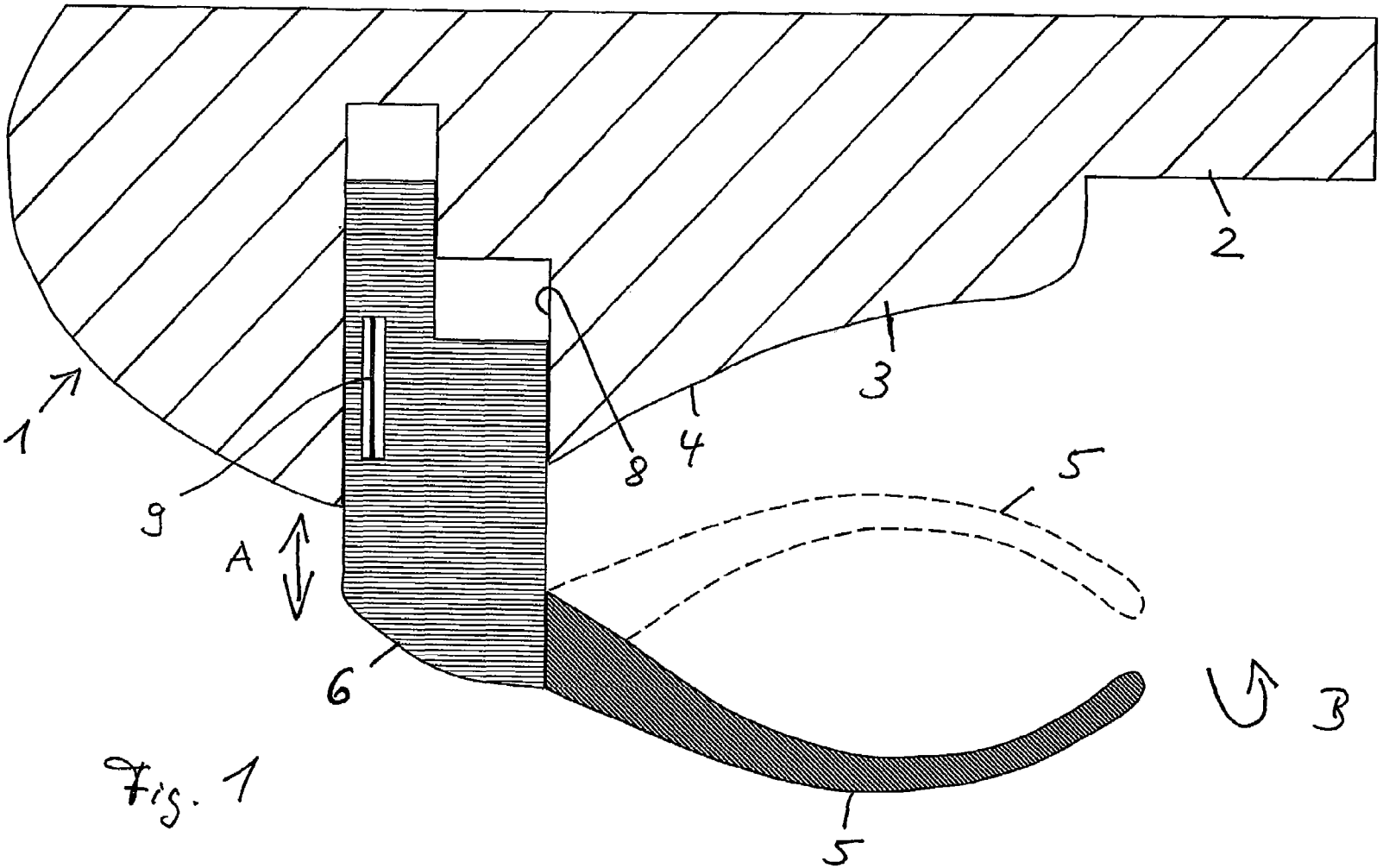
FIG. 1 schematically shows a longitudinal section through a body of an electric guitar with a bow in two positions, and FIG. 2 schematically shows a section of the bow shown in FIG. 1 with rotatable coupling to a shaft.

FIG. 1 shows an electric guitar (1) with a neck (2) and a body (3). The body (3) has a first side wall (not shown), facing the guitar player, and a second side wall (4), facing away from the guitar player. The two side walls of the body (3) delimit a front and a back of the body (3) at the edges. The body (3) preferably has a bulbous physical shape which is flattened at the front and back and which may also be in figure-of-eight form. The body (3) is preferably solid or filled and may also be provided with cavities which can influence the acoustics, in particular, and can result in a weight saving too.

The second side wall (4) has an associated bow (5) which extends at least in sections along the second side wall (4). The distance between the bow (5) and the second side wall (4) is adjustable and the bow (5) has an arc shape which can be rotated into a concave and a convex position relative to the second side wall. The bow (5) therefore forms a bridge-like additional side wall which can be folded in and out and which alters the physical shape of the electric guitar (1) ergonomically. To this end, the bow (5) is offset from the second side wall (4) essentially in parallel and forms a support face for resting the electric guitar when playing sitting down, for example. To this end, the bow (5) has a minimal width which allows it to rest comfortably when playing sitting down.

For playing sitting down, the bow (5) adopts the position shown in a solid line in FIG. 1, for example. To this end, the bow (5) is extended outward in the direction of arrow A, e.g. has its height adjusted at the side, so that the distance between the bow (5) and the second side wall (4) is greater than in a retracted state. The bow (5) is rotatably coupled to a shaft (6) which is routed in a recess 8 in the body (3) such that it can move for the purpose of adjusting the height of the bow. A locking device (9) can be used to lock the shaft (6) in selectable retracted and/or extended positions and hence to anchor it securely to the body (3).

Figure 2:
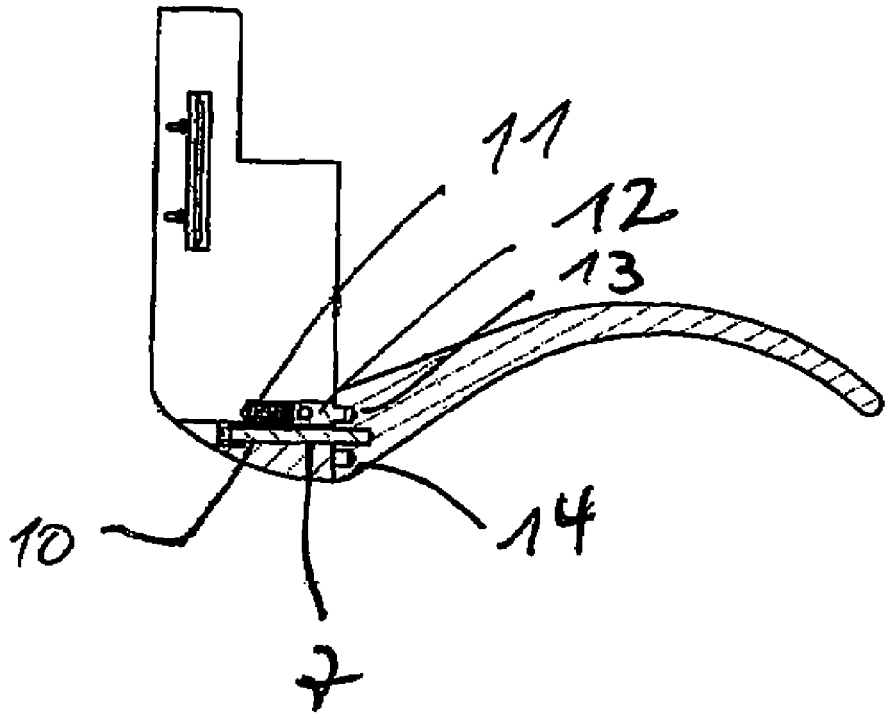

The bow (5) is coupled to the shaft (6) by means of a swivel joint (7), as shown in FIG. 2. The ability to rotate is indicated by arrow B. In this case, the bow (5) can preferably be locked in two swivel positions, which are shown in FIG. 1 firstly in a solid line and secondly in a dashed line. Its arcuate shape means that the bow (5) is essentially in the shape of a sickle and can therefore adopt a convex and a concave position relative to the second side wall (4). The position of the bow (5), which is shown in a solid line, shows the bow in a convex position, i.e. the outer contour of the body (3) is then determined by the bow (5) in front of the second side wall, which alters the body (3) ergonomically. In this case, the convex position of the bow (5) means that it is a temporary additional side wall whose shape approximates a side wall section of a body of an acoustic guitar, which broadens the body (3) of the electric guitar (1).

In this case, the free end of the bow (5) is arranged on the body (3) so as to be directed toward the neck (2).

The bow (5) can also be rotated into the position shown in a dashed line. The bow (5) is then in a concave position relative to the second side wall (4). The bow (5) can thus be pivoted into a folded-in position, for example when the electric guitar (1) is being played standing up. The longitudinal movement of the shaft (6) allows the bow (5) to be moved up to the second side wall (4) at a short distance therefrom.

In this context, the positions of the bow (5) are preferably oriented flush with the body (3). The swivel joint (7) used between the bow (5) and the shaft (6) can be a known swivel joint. As FIG. 2 shows, the swivel joint (7) comprises a swivel pin (10) and a locking pin (12), which is spring-pretensioned by means of a compression spring (11) and which can be latched into locking recesses (13), (14) in the bow (5). The locking pin (12) can be operated in a known manner using an operating lever.

What is claimed is:

1. An electric guitar with a neck and a body which has a first side wall, facing the guitar player, and a second side wall, facing away from the guitar player, said side walls delimiting a front and a back of the body at the edges, wherein the second side wall has a shaft embedded in the body providing a pivot joint, and an associated arcuate bow coupled to the pivot joint in an orientation extending along the second side wall at least in sections, the bow which can have their distance from the second side wall adjusted, and the bow's arc shape can be rotated into a concave and a convex position relative to the side wall.

2. The electric guitar as claimed in claim 1, wherein said shaft is routed in the body such that its height can be adjusted.

3. The electric guitar as claimed in claim 1, wherein the bow can be locked in the concave and convex positions.

4. The electric guitar as claimed in claim 1, wherein the bow has its free end directed toward the neck.

5. The electric guitar as claimed in claim 1, wherein the body has a bulbous second side wall, and this can be simulated in the form of a bridge by the bow at a selectable distance from the second side wall.

6. The electric guitar as claimed in claim 1, wherein the bow is arranged flush with the body.

* * * * *